US006546903B2

(12) United States Patent
Taniguchi et al.

(10) Patent No.: US 6,546,903 B2
(45) Date of Patent: Apr. 15, 2003

(54) CONTROL SYSTEM FOR ELECTROMAGNETIC ACTUATOR

(75) Inventors: Ikuhiro Taniguchi, Kanagawa (JP); Taketoshi Kawabe, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/727,788

(22) Filed: Dec. 4, 2000

(65) Prior Publication Data

US 2001/0002586 A1 Jun. 7, 2001

(30) Foreign Application Priority Data

Dec. 3, 1999 (JP) ..... 11-345377

(51) Int. Cl.[7] ..... F01L 9/04
(52) U.S. Cl. ..... 123/90.11; 361/139; 361/152
(58) Field of Search ..... 123/90.11; 361/139, 361/152, 154, 160, 194

(56) References Cited

U.S. PATENT DOCUMENTS

| | | | | | |
|---|---|---|---|---|---|
| 5,596,956 | A | | 1/1997 | Ogawa et al. | 123/90.11 |
| 5,765,513 | A | * | 6/1998 | Diehl | 123/90.11 |
| 5,775,276 | A | * | 7/1998 | Yanai | 123/90.11 |
| 5,782,211 | A | * | 7/1998 | Kamimaru | 123/90.11 |
| 5,889,405 | A | * | 3/1999 | Yanai et al. | 123/90.11 |
| 6,167,852 | B1 | * | 1/2001 | Kamimaru | 123/90.11 |
| 6,176,208 | B1 | * | 1/2001 | Tsuzuki | 123/90.11 |
| 6,279,523 | B1 | * | 8/2001 | Iida et al. | 123/90.11 |
| 6,354,253 | B1 | * | 3/2002 | Katsumata et al. | 123/90.11 |

FOREIGN PATENT DOCUMENTS

| | | |
|---|---|---|
| JP | 8-170509 | 7/1996 |
| JP | 11-355106 | 12/1999 |

* cited by examiner

*Primary Examiner*—Thomas Denion
*Assistant Examiner*—Jaime Corrigan
(74) *Attorney, Agent, or Firm*—Foley & Lardner

(57) ABSTRACT

A control system for an electromagnetic actuator actuates an intake or exhaust valve. The actuator includes first and second electromagnets which develop an electromagnetic attraction force the strengths of which depend on the amount of current supplied thereto. A spring biases an armature between the electromagnets to a neutral position therebetween. The control system comprises a control circuit which (a) controls the amount of current supplied to the first electromagnet thereby restricting a moving velocity of the armature, at a first stage in a course of changing the armature from a first position to a second position; and (b) supplies current to the second electromagnet at a timing at which the armature approaches the second electromagnet upon the biasing force of the spring thereby attracting the armature to the second position, at a second stage in the course of changing the armature from the first position to the second position.

18 Claims, 5 Drawing Sheets

VALVE-OPENING COMMAND
VALVE-CLOSING COMMAND
ECU FOR ENGINE CONTROL
8
CONTROLLER
1
POSITION SIGNAL
CLOSING-SIDE ELECTROMAGNET CURRENT-CONTROLLING SECTION
9
OPENING-SIDE ELECTROMAGNET CURRENT-CONTROLLING SECTION
10
ELECTRIC SOURCE SECTION
13
C
E
D
2
59
60
58
11
57
57a
12
55
56
52
53
51
54
54a
52a
54b

CONTROL SYSTEM FOR ELECTROMAGNETIC ACTUATOR

BACKGROUND OF THE INVENTION

This invention relates to improvements in a control system for an electromagnetic actuator, and more particularly to the control system for the electromagnetic actuator of the type having two electromagnets and an armature whose position is freely changeable upon receiving attraction force from each electromagnet.

As intake and exhaust valves of a vehicular internal combustion engine, electromagnetically actuated valves (valves actuated by electromagnetic actuators) have been proposed to be used in place of conventional valves driven by a cam mechanism. The electromagnetically actuated valves not only can render the cam mechanism unnecessary but also can readily optimize opening and closing timings of the intake and exhaust valves in accordance with operational condition of the engine, thereby improving power output and fuel economy of the engine.

A typical example of such an electromagnetically actuated valve is disclosed in Japanese Provisional Publication No. 8-170509, in which an engine valve (intake or exhaust valve) is connected to an armature movably disposed between an opening-side electromagnet for opening the valve and a closing-side electromagnet for closing the valve; the valve being normally biased to a position at which the valve is partially opened, under a biasing force of a pair of springs. Before engine starting, the opening-side and closing-side electromagnets are alternately energized to apply electromagnetic forces to the armature to make vibration resonance of the armature, under action of the springs, and thereby increase vibration amplitude of the armature. Then, initialization is carried out to keep the armature at an opening position for opening the valve and a closing position for closing the valve. Thereafter, when the valve is to be changed from its closed state to its opened state, current supply to the closing-side electromagnet is interrupted so that the valve and the armature are moved under the bias of the springs. Then, at a timing at which the armature approaches the opening-side electromagnet, current supply to the opening-side electromagnet is initiated to attract the armature thereby opening the valve. A similar operation is made also when the valve is to be changed from the opened state to the closed state. In this arrangement, current supply to the electromagnet is initiated at the timing at which the armature approaches the electromagnet. Consequently, this arrangement can reduce an electromagnetic force required for the electromagnet, thereby reducing the size of a driving device for the valve.

Additionally, it has been also proposed that an amount of current to be supplied to an electromagnet is variable in accordance with the position of an armature in order to decrease the velocity of the armature when the armature is attracted to the electromagnet. This reduces collision noise of the armature and ensures the durability of an electromagnetic actuator for an engine valve. This technique is disclosed in earlier Japanese Patent Application No. 11-355106 having inventors including the inventors of the present application. The Japanese Patent Application is based on Japanese Patent Application No. 10-359591 which was abandoned.

SUMMARY OF THE INVENTION

Drawbacks have been encountered in the internal combustion engines provided with the above conventional electromagnetically actuated valves, as set forth below. That is, when, for example, misfire occurs in the engine so that pressure within an engine cylinder (to be applied to the valve) is sharply lowered, a driving force required for opening the valve is reduced and therefore a moving velocity of the valve and the armature connected to the valve becomes excessively large under the biasing force of the springs upon interruption of current supply to the closing-side electromagnet. This renders the velocity of the armature excessively large relative to the target velocity when current supply to the opening-side electromagnet is initiated, so that the control system for the electromagnetically actuated valves becomes out of control.

If the control system becomes out of control, the valve is unavoidably kept partially open and kept at a neutral position. Therefore, exhaust gas will be transferred to the intake side while exhaust gas in the engine cylinder, generated during the misfire, will be transferred to the intake sides of other engine cylinders through the intake valves thereby affecting combustion in other engine cylinders. Additionally, after the valve has been kept at its neutral position, torque cannot be generated in the misfired engine cylinder until an initialization under the above-mentioned vibration resonance has been accomplished.

Furthermore, when the neutral position of the valve is shifted, for example, owing to the lack of uniformity in the biasing force of each spring and the change in the biasing force of the springs upon lapse of time (other than the above-discussed misfire), the moving velocity of the valve becomes too high thereby causing problems similar to those previously discussed.

Therefore, it is an object of the present invention to provide an improved control system for an electromagnetic actuator, which can effectively overcome drawbacks encountered in the conventional similar techniques.

Another object of the present invention is to provide an improved control system for an electromagnetic actuator, which can reduce collision noise of an armature while ensuring a high response characteristics of the actuator, and ensure a high durability of a movable section (including the armature) and electromagnets.

A further object of the present invention is to provide an improved control system for an electromagnetic actuator, which can prevent the moving velocity of an armature from becoming excessively large under biasing force of springs, thereby accomplishing stable control for changing position of the armature between two electromagnets.

An aspect of the present invention resides in a control system for an electromagnetic actuator including first and second electromagnets each of which develops an electromagnetic attraction force upon supply of current thereto, the electromagnetic attraction force changing in accordance with an amount of current to be supplied thereto; an armature disposed to be attractable to one of the first and second electromagnets under the electromagnetic attraction force; and a spring for developing biasing force for biasing the armature to be put at a neutral position between the first and second electromagnet. The control system comprises a control circuit programmed to carry out (a) decreasing the amount of current to be supplied to the first electromagnet and controlling the amount of current to be supplied to the first electromagnet so as to restrict a moving velocity of the armature, at a first stage in a course of changing the armature from a first position at which the armature is kept attracted to the first electromagnet to a second position at which the armature is kept attracted to the second electromagnet; and (b) initiating supply of current to the second electromagnet at a timing at which the armature approaches the second electromagnet upon the biasing force of the spring so as to attract the armature to be kept at the second position, at a second stage in the course of changing the armature from the first position to the second position, the second stage being after the first stage.

Another aspect of the present invention resides in a control system for an electromagnetically actuated valve. The control system comprises first and second electromagnets each of which develops an electromagnetic attraction force upon supply of current thereto. The electromagnetic attraction force changes in accordance with an amount of current to be supplied thereto. An armature is disposed to be attractable to one of the first and second electromagnets under the electromagnetic attraction force. The armature is connected to the electromagnetically actuated valve. A spring is provided for developing biasing force for biasing the armature to be put at a neutral position between the first and second electromagnet. The control system comprises a control circuit programmed to carry out (a) decreasing the amount of current to be supplied to the first electromagnet and controlling the amount of current to be supplied to the first electromagnet so as to restrict a moving velocity of the armature, at a first stage in a course of changing the armature from a first position at which the armature is kept attracted to the first electromagnet to a second position at which the armature is kept attracted to the second electromagnet; and (b) initiating supply of current to the second electromagnet at a timing at which the armature approaches the second electromagnet upon the biasing force of the spring so as to attract the armature to be kept at the second position, at a second stage in the course of changing the armature from the first position to the second position, the second stage being after the first stage.

A further aspect of the present invention resides in a method of controlling an electromagnetic actuator including first and second electromagnets each of which develops an electromagnetic attraction force upon supply of current thereto, the electromagnetic attraction force changing in accordance with an amount of current to be supplied thereto; an armature disposed to be attractable to one of the first and second electromagnets under the electromagnetic attraction force; and a spring for developing biasing force for biasing the armature to be put at a neutral position between the first and second electromagnet. The method comprises (a) decreasing the amount of current to be supplied to the first electromagnet and controlling the amount of current to be supplied to the first electromagnet so as to restrict a moving velocity of the armature, at a first stage in a course of changing the armature from a first position at which the armature is kept attracted to the first electromagnet to a second position at which the armature is kept attracted to the second electromagnet; and (b) initiating supply of current to the second electromagnet at a timing at which the armature approaches the second electromagnet upon the biasing force of the spring so as to attract the armature to be kept at the second position, at a second stage in the course of changing the armature from the first position to the second position, the second stage being after the first stage.

BRIEF DESCRIPTION OF THE DRAWINGS

In the drawings, like reference numerals designate like elements and parts throughout all figures, in which.

DETAILED DESCRIPTION OF THE INVENTION

Figure 1:
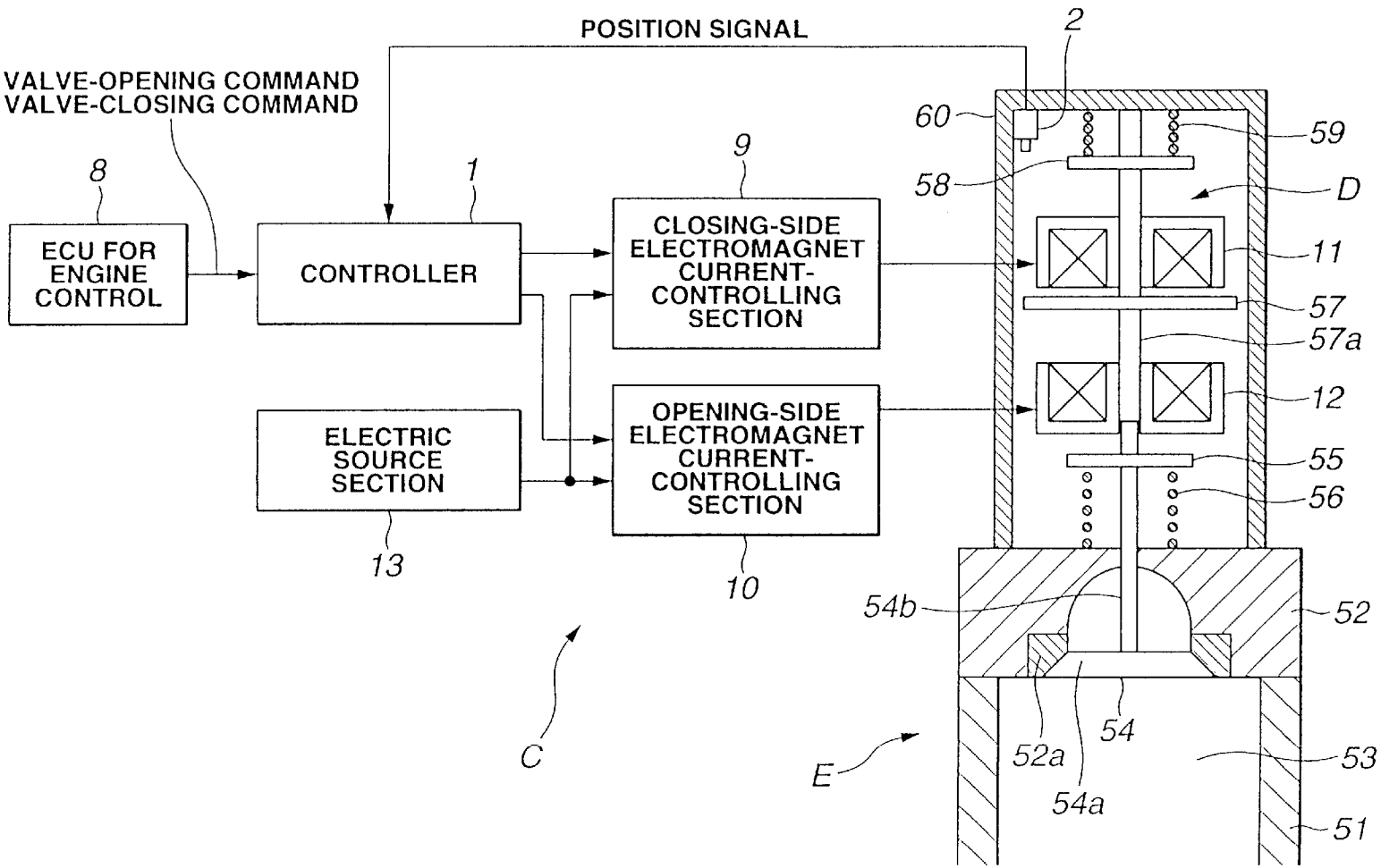
FIG. 1 is a schematic illustration of an embodiment of a control system for an electromagnetic actuator, according to the present invention.

Referring now to FIG. 1 of the drawings, an embodiment of a control system for an electromagnetic actuator, according to the present invention, is generally illustrated by the reference character C and incorporated with an automotive internal combustion engine E. The engine E includes a cylinder block 51 formed with a plurality of engine cylinders 53 though only one cylinder 53 is shown. A cylinder head 52 is fixed to the top surface of the cylinder block 51 to define a combustion chamber (not identified) in each cylinder 53. The engine E is provided with intake and exhaust valves (engine valves) for each cylinder 53 or for each combustion chamber, though only one engine valve (intake or exhaust valve) 54 is shown in FIG. 1. Valve 54 has a valve head 54*a* which is seatable on valve seat 52*a* embedded in cylinder head 52. The valve 54 is electromagnetically actuated by an electromagnetic actuator or electromagnetically driving device D and, therefore, is also referred to as an "electromagnetically actuated valve". Valve 54 has a valve stem 54*b* which extends upwardly and has an upper section to which a spring retainer 55 is fixed. A coil spring 56 is disposed between the spring retainer 55 and the cylinder head 52 in order to bias an armature 57 toward a closing-side electromagnet 11 to close the valve 54.

Housing 60 is disposed on cylinder head 52 so as to cover the electromagnetically driving device D for the valve 54. The electromagnetically driving device D is disposed inside housing 60 and includes closing-side electromagnet 11 and opening-side electromagnet 12 which are vertically separate from each other and located opposite to each other. The opening-side and closing-side electromagnets are adapted to function to open and close valve 54, respectively. Closing-side electromagnet 11 and opening-side electromagnet 12 are coaxially arranged with each other and fixed relative to housing 60. Armature 57 formed of soft magnetic material is disposed coaxial with and slidably movable between electromagnets 11, 12. Armature 57 is fixed on armature shaft 57*a* which extends vertically through the centers of electromagnets 11, 12. Armature shaft 57*a* is fixedly connected to and coaxially aligned with valve stem 54*b*. Spring retainer 58 is disposed above the closing-side electromagnet 11 and fixed to the armature shaft 57*a*. Coil spring 59 is disposed between spring retainer 58 and the inner surface of a top wall section of housing 60 in order to bias the armature in a direction to open the valve 54 or to a valve opening-side.

Armature position sensor 2 constituted of a laser displacement meter or the like is disposed to the top wall section of the housing 60 in order to detect the position of a movable section (including valve 54, armature shaft 57*a* and armature 57) and to output a position signal representative of the position of the movable section. The position signal is output to controller 1 for controlling the electromagnetically driving device D.

Controller 1 is supplied with a valve-opening command and a valve-closing command output from electronic control unit (ECU) 8 for controlling the engine. Controller 1 is arranged to output target currents respectively to closing-side electromagnet current-controlling section 9 and opening-side electromagnet current-controlling section 10, respectively, in accordance with the valve-opening and valve-closing commands. The current-controlling section 9 is arranged to control an electromagnetic force of the closing-side electromagnet 11 by controlling an amount of current to be supplied from electric source section 13 through the current-contorlling section 9 to the closing-side electromagnet 11 in accordance with the target current from the controller 1 under PWM control. Similarly, the current-controlling section 10 is arranged to control an electromagnetic force of the opening-side electromagnet 12 by controlling an amount of current to be supplied from the electric source 13 through the current control section 10 to the opening-side electromagnet 12 in accordance with the target current from the controller 1 under PWM control.

Figure 2:
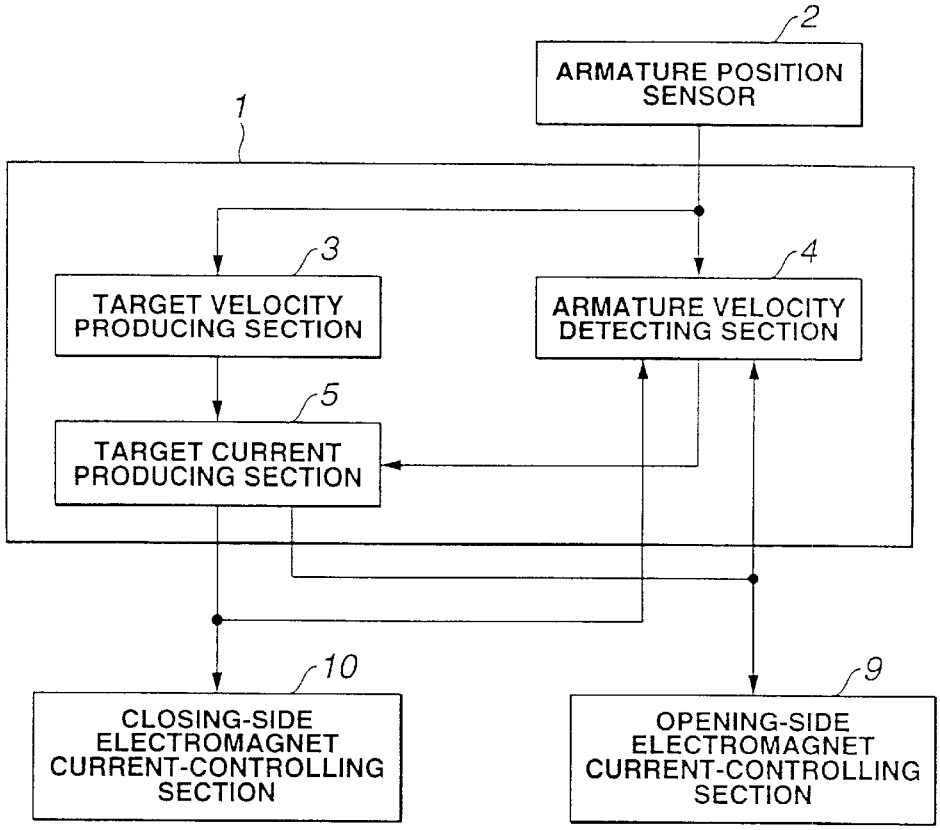
FIG. 2 is a block diagram of a controller in the control system of FIG. 1.

Controller 1 has an arrangement shown in FIG. 2. Controller 1 includes a target velocity producing section 3 which is adapted to produce a target velocity (for the armature 57) in accordance with the position signal output from the armature position sensor 2, and in response to the valve-opening or valve-closing command from the ECU 8. Here, the target velocity (or target orbit) corresponding to the position of the armature 57 is set in accordance with a moving region of the armature 57.

Figure 3:
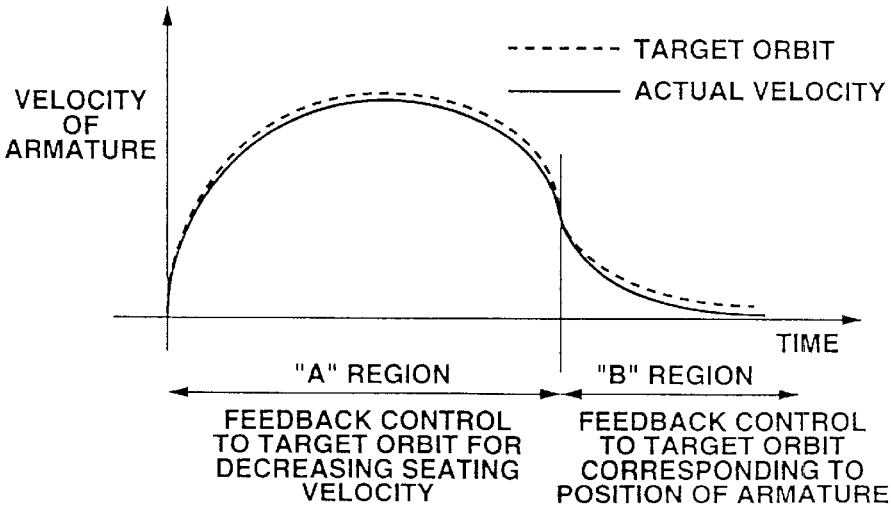
FIG. 3 is a graph showing the relationship between the velocity of an armature and time, in connection with the control system of FIG. 1.

Such setting of the target velocity will be discussed in detail with reference to FIG. 3.

When the valve-opening command is output from the ECU 8, the following control operation is accomplished: In an "A" region extending from a position at which the armature 57 is attracted to the closing-side electromagnet 11 to a certain position at which the armature 57 approaches the opening-side electromagnet 12, a target orbit for the armature 57 is set on the assumption that the armature 57 normally moves under the biasing force of the coil springs 56, 59 when current supply to the closing-side electromagnet 11 is interrupted. The target orbit is set having target velocities which are respectively moving velocities of the armature 57 at the positions of the armature 57. A feedback control to the target orbit for decreasing the seating velocity (at which the armature 57 is to be seated on the electromagnet) of the armature 57 is carried out in the "A" region. In a "B" region extending from the above certain position to a position at which the armature 57 is attracted to the opening-side electromagnet 12, a target orbit is set so that the moving velocity of the armature 57 gradually decreases and approaches around zero when the armature 57 is attracted to the opening-side electromagnet 12. A feedback control to the target orbit corresponding to the position of the armature 57 is carried out in the "B" region.

When the valve-opening command is output from the ECU 8, the following control operation is accomplished: In an "A" region extending from a position at which the armature 57 is attracted to the opening-side electromagnet 12 to a certain position at which the armature 57 approaches the closing-side electromagnet 11, a target orbit for the armature 57 is set on the assumption that the armature 57 normally moves under the biasing force of the coil springs 56, 59 when current supply to the opening-side electromagnet 12 is interrupted. The target orbit is set having target velocities which are respectively moving velocities of the armature 57 at the positions of the armature 57. In a "B" region extending from the above certain position to a position at which the armature 57 is attracted to the closing-side electromagnet 11, a target orbit is set so that the moving velocity of the armature 57 gradually decreases and approaches around zero when the armature 57 is attracted to the closing-side electromagnet 11.

Figure 4:
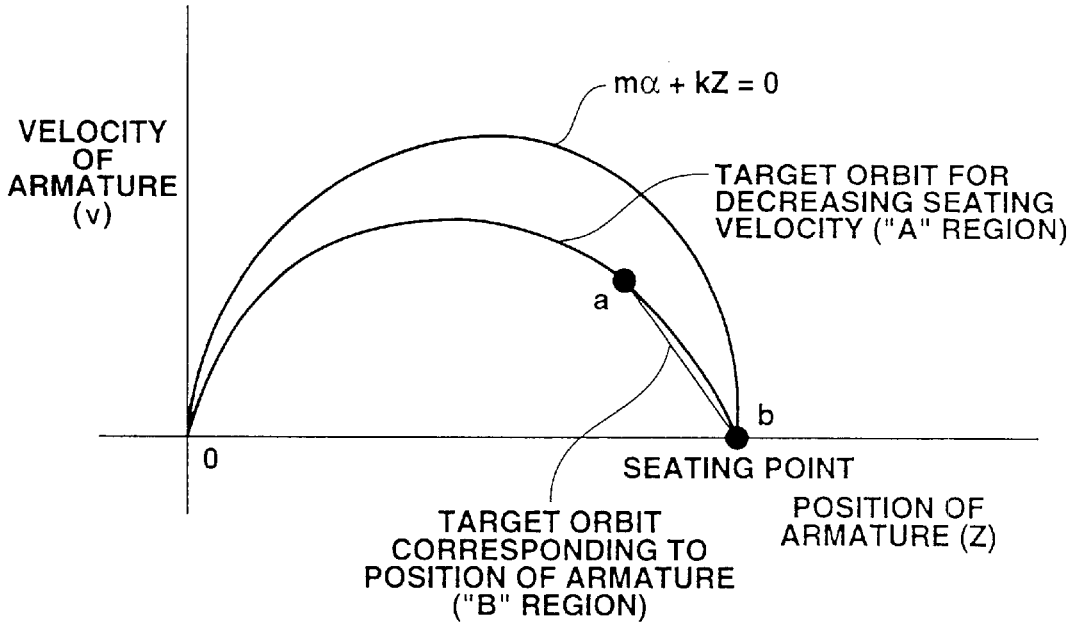
FIG. 4 is a graph showing the relationship between the velocity of the armature and the position of the armature, in connection with the control system of FIG. 1.

More specifically, as shown in FIG. 4, on the assumption that the coil springs have no viscous friction, the orbit of the armature takes a curve o-b. However, the coil springs have, in fact, viscous friction, and therefore the velocity of the armature decreases to take a curve o-a in the "A" region in which the armature reaches the above certain position, in which the target orbit for the armature is set based on the curve o-a. In the "B" region over the above certain position, for example, the target orbit takes a line a-b so that armature 57 is decelerated at a certain deceleration relative to a moving amount of the armature. The point b in FIG. 4 corresponds to a seating point at which the armature is seated on the electromagnet.

Turning back to FIG. 2, controller 1 includes an armature velocity detecting section 4 which is adapted to detect an actual velocity of the armature 57 in accordance with the position signal output from the armature position sensor 2. A target current producing section 5 is adapted to produce a target current in accordance with the target velocity produced by the target velocity producing section 3 and the actual velocity of the armature 57 detected by the armature velocity detecting section 4. The target current is for the closing-side electromagnet 11 or the opening-side electromagnet 12. More specifically, the target currents are respectively supplied to the closing-side electromagnet current-controlling section 9 and the opening-side electromagnet current-controlling section 10. In fact, as later discussed, in the "A" region, current is supplied only to the electromagnet from which the armature 57 is separated, only when the velocity of the armature 57 is high relative to the target orbit; and a control for current to be supplied to the electromagnet is carried out from a time at which the armature 57 approaches the electromagnet (to which the armature 57 is moved) by a certain distance.

Figure 5:
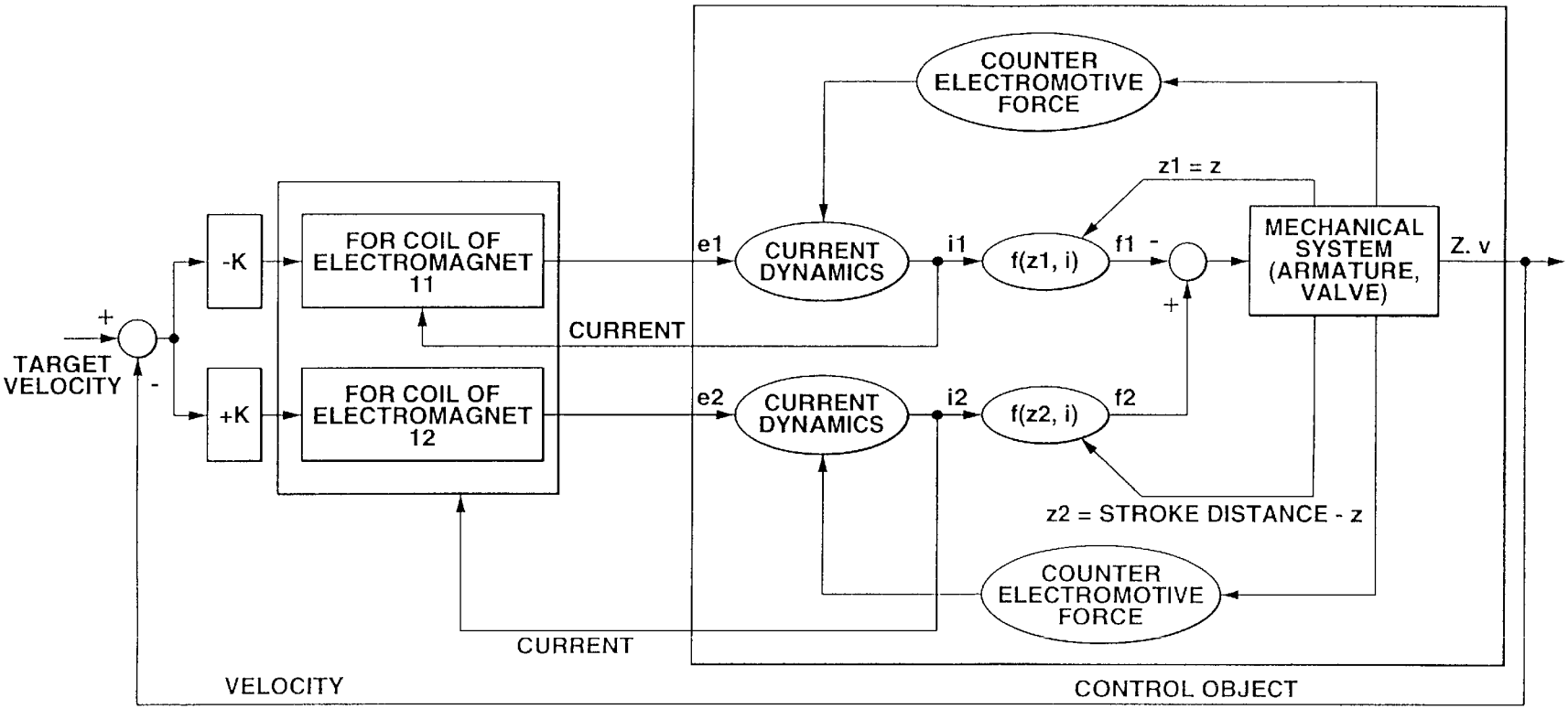
FIG. 5 is a block diagram showing the control executed by the control system of FIG. 1.

The control for current to be supplied to electromagnet 11, 12 will be discussed in detail with reference to FIG. 5.

A gap z1 between the armature 57 and the closing-side electromagnet 11 is assumed to be z, while the gap z2 between the armature 57 and the opening-side electromagnet 12 is assumed to be a value (a distance of the stroke of the armature—z). Accordingly, the velocity (dz/dt) of the armature 57 is represented as a positive velocity when the armature 57 moves in a direction in which the gap z1 (between the armature 57 and the closing-side electromagnet 11) increases while the gap z2 (between the armature 57 and the opening-side electromagnet 12) decreases.

A feedback correction current is produced by multiplying a difference (Vt−Vr) between the target velocity Vt and the actual velocity Vr (=dz/dt) of the armature 57 by a negative gain −K for the closing-side electromagnet 11 or a positive gain +K for the opening-side electromagnet 12. The target current is obtained by adding the feedback correction current to an actual current i. The control voltages e1, e2, by which the target currents are obtained, are fed to the closing-side electromagnet 11 and the opening-side electromagnet 12, respectively. Counter electromotive forces are generated, respectively, in the closing-side electromagnet 11 and the opening-side electromagnet 12 under the actions of the control voltages e1, e2 and the movement of the armature 57. Under the effects of the counter electromotive forces, actual currents i1, i2 are determined and are fed to the closing-side electromagnet 11 and the opening-side electromagnet 12, respectively. Electromagnetic attraction forces f1, f2 of the closing-side electromagnet 11 and the opening-side electromagnet 12 are determined in accordance with the gaps z1, z2 and the actual currents i1, i2, respectively. The electromagnetic attraction forces f1, f2 act on the armature 57. Thus, the armature 57 and the valve 54 connected to the armature 57 are driven by the electromagnetic attraction forces f1, f2 and the biasing forces of the coil springs 56, 59.

The armature 57 is suspended by the coil springs 56, 59. The dimension and spring constant of the coil springs 56, 59 are set so that the armature 57 is located generally at the center between the closing-side electromagnet 11 and the opening-side electromagnet 12 when no current is fed to the closing-side electromagnet 11 or the opening-side electromagnet 12.

Here, it will be understood that the natural frequency $f_0$ of a spring and mass system constituted by the valve 54 and the movable section including the armature 57 is represented by an equation of $f_0=2\pi\sqrt{(K/m)}$ where K is the combined spring constants and m is the total mass.

Now, in an initial operation prior to engine starting, current is fed alternately to closing-side electromagnet 11 and to opening-side electromagnet 12, at a frequency corresponding to the above natural frequency fo. Then, resonance vibration of the movable section is made thereby gradually increasing the amplitude of vibration. At the final stage of the initial operation, for example, the armature is attracted to closing-side electromagnet 11, and then this attracted state of the armature is maintained.

Subsequently, at engine starting or during normal engine operation, for example, when valve 54 is to be opened, the target velocity corresponding to the target orbit in the above-mentioned "A" region is output for closing-side electromagnet 11 attracting armature 57. The target orbit is set such that the target velocity is the moving velocity of armature 57 which makes its normal movement under the biasing force of coil springs 56, 59 when current supply to closing-side electromagnet 11 is interrupted, as discussed before. Therefore, in a normal condition, the amount of current to be fed to closing-side electromagnet 11 is abruptly decreased, and then the current supply is interrupted.

As a result, the movable section including the armature is initiated to move downwardly under the biasing force of coil springs 56, 59. Under energy loss due to frictional force and the like, it is impossible to move armature 57 to a valve fully opened position at which valve 54 is fully opened, only under the biasing force of the coil spring. Accordingly, current is fed to opening-side electromagnet 12 when the armature sufficiently approaches opening-side electromagnet 12 and comes to a position at which the electromagnetic force of the opening-side electromagnet become effective, thereby assisting the movement of armature 57. That is, when armature 57 passes through the "A" region and reaches a changing point between the "A" and "B" regions, the target velocity corresponding to the target orbit in the "B" region is output for opening-side electromagnet 12.

In the normal condition, the target velocity and the actual velocity of armature 57 at the changing point generally coincide with each other. Here, from this condition, the armature is to be largely decelerated under the biasing force whose direction is upwardly changed; however, feedback control of velocity is carried out corresponding to the target orbit by causing opening-side electromagnet 12 to develop an electromagnetic attraction force upon the opening-side electromagnet being supplied with current in an amount corresponding to the deviation (Vt−Vr) between the target velocity and the actual velocity.

For example, where the target orbit is represented by the curve a-b as shown in FIG. 4, the armature 57 is decelerated at a certain deceleration relative to the amount of movement of the armature. Accordingly, the armature approaches the opening-side electromagnet 12 at a high velocity at the initial stage of the current supply; however, the velocity of the armature 57 can be lowered to a value around zero when the armature 57 is attracted to the opening-side electromagnet. As a result, collision noise is reduced while ensuring a high response characteristic thereby obtaining a high durability of the movable section and the electromagnets. Additionally, it is also possible to set the target orbit such that the armature 57 is stopped immediately before the armature 57 is attracted to the electromagnet under balance between the spring biasing force and the electromagnetic attraction force, as disclosed in the above-mentioned earlier Japanese Patent Application. This may prevent a collision of the armature and the electromagnet or sufficiently minimize the velocity of the armature 57 if and when a collision occurs due to error or delay.

In case a misfire occurs in the engine cylinder provided with the electromagnetically actuated valve in the internal combustion engine, lowering pressure within the engine cylinder, or in case the balance between the biasing forces of the coil springs 56, 59 is broken (for example, upon a shift of the neutral position of the armature 57 toward a position for opening the valve 54), the driving force required for opening the valve is reduced. As a result, the amount of current to be fed to the closing-side electromagnet 11 is abruptly reduced relative to the output of the target velocity corresponding to the target orbit in the above-mentioned "A" region. Accordingly, the actual velocity Vr of armature 57 exceeds the target velocity Vt, so that the difference (Vt−Vr) takes a negative value. Consequently, in FIG. 5, for the closing-side electromagnet 11, the positive feedback correction current obtained by multiplying the negative difference (Vt−Vr) by the negative gain −K is added to the actual current thereby increasingly correcting the amount of current to be fed to the closing-side electromagnet. In other words, the amount of current to be fed to the closing-side electromagnet 11 is abruptly decreased at the initial stage. However, when the actual velocity Vr exceeds the target velocity Vt, current supply is continued while making the increasing correction by an amount corresponding to the excess. Then, an upward electromagnetic force is generated at the closing-side electromagnet 11 against the downward biasing force due to the biasing forces of the coil springs 56, 59, so that the armature 57 is decelerated under the electromagnetic force thereby restricting the moving velocity of the armature 57 to a suitable value. It is to be noted that the current supply to the closing-side electromagnet 11 is stopped at least when the armature 57 comes into the "B" region so that the actual velocity is lowered relative to the target velocity, as later discussed. Otherwise, the current supply to the closing-side electromagnet 11 may be compulsorily terminated at the changing point from the "A" region to the "B" region. This may be similarly applied when controlling the current supply to the opening-side electromagnet 12 when the valve 54 is opened, as later discussed.

As a result, the moving velocity of armature 57 can be prevented from becoming excessive when control for current supply to opening-side electromagnet 12 is initiated at the changing point from the "A" region to the "B" region, thereby accomplishing normal current supply control to opening-side electromagnet 12.

Also when valve 54 is to be closed, a similar control to the above is carried out. That is, the target velocity corresponding to the target orbit in the above-mentioned "A" region is output for opening-side electromagnet 12 attracting armature 57. The target orbit is set such that the target velocity is the moving velocity of armature 57 which makes its normal movement under the biasing force of coil springs 56, 59 when current supply to opening-side electromagnet 12 is interrupted. Therefore, in the normal condition, the amount of current to be fed to opening-side electromagnet 12 is abruptly decreased, and then the current supply is interrupted.

By this, the movable section is moved upward under the spring forces of the coil springs 56, 59. When the armature 57 has reached the changing point from the "A" region to the "B" region, the target velocity corresponding to the target orbit in the "B" region is output for the closing-side electromagnet 11. Accordingly, although it is assumed that the armature 57 is to be largely decelerated under the biasing force (whose direction is downwardly changed), feedback control of the velocity is carried out corresponding to the target orbit by causing the opening-side electromagnet 12 to develop an electromagnetic attraction force upon the closing-side electromagnet 11 being supplied with current in an amount corresponding to the difference (Vt−Vr) between the target velocity and the actual velocity. This can reduce collision noise while ensuring a high response characteristic of the electromagnetic actuator, thereby obtaining a high durability of the movable section and the electromagnets, similar to the previously mentioned case of opening the valve 54.

It will be understood that a lowered pressure within the cylinder 51 hardly affects the driving force required for closing the valve 54. However, the driving force is reduced in case the balance between the biasing forces of the coil springs 56, 59 is broken, for example, upon a shift of the neutral position of the armature 57 toward a position for closing the valve 54. In such a case, when the amount of current to be fed to the opening-side electromagnet 12 is abruptly reduced relative to the output of the target velocity corresponding to the target orbit in the above-mentioned "A" region, the actual velocity Vr of the armature 57 exceeds the target velocity Vt. Here, the velocity of the armature 57 is set as a positive value in a moving direction (of the armature 57) for opening the valve 54 while setting it as a negative value in a moving direction for closing the valve. Accordingly, when the actual velocity Vr exceeds the target velocity Vt, the difference (Vt−Vr) takes a positive value. Consequently, in FIG. 5, for the opening-side electromagnet 12, a positive feedback correction current obtained by multiplying the positive difference (Vt−Vr) by the positive gain +K is added to the actual current thereby increasingly correcting the amount of current to be fed to the opening-side electromagnet 12. In other words, similar to the case of closing the valve 54, the amount of current to be fed to the opening-side electromagnet 12 is abruptly decreased at the initial stage. However, when the actual velocity Vr exceeds the target velocity Vt, current supply is continued while making the increasing correction by an amount corresponding to the excess. Then, downward electromagnetic force is generated at the opening-side electromagnet 12 against the upward biasing force due to the biasing forces of the coil springs 56, 59, so that the armature 57 is decelerated under the electromagnetic force thereby restricting the movement velocity of the armature 57 to a suitable value.

As a result, the moving velocity of the armature 57 can be prevent from becoming excessive when control for current supply to the closing-side electromagnet 11 is initiated at the changing point from the "A" region to the "B" region, thereby accomplishing normal current supply control to the closing-side electromagnet 11.

It will be understood that the control for restricting the moving velocity of the armature 57 at the changing point in opening or closing the valve 54 may be applied onto an arrangement in which current supply to an electromagnet is interrupted simultaneously with the initiation of changing from opening to closing of the valve or vice versa, in such a manner as to output the target velocity corresponding to the target orbit. By this, a control program, based on a target orbit for an armature attracted to an electromagnet by inherent magnetic attraction force, is employed to replace the target orbit with another target orbit.

Additionally, for example, it is possible to use feedback control to restrict moving velocity of the armature 57 when the moving velocity is too high upon detecting the moving velocity of the armature at the above-mentioned changing point. In such a case, restricting the moving velocity (in accordance with the detection result of the moving velocity) can be accomplished in opening and closing the valve at the next time. This can address faulty or small fluctuations of the moving velocity (proceeding with a lapse of time), such as unbalance in the biasing forces of the coil springs. However, this cannot address a suddenly occurring misfire or the like in real time control. If a misfire in the engine cylinder occurs (so that the valve remains partially opened upon the failure of control), regaining control at the next time would be impossible. In contrast, according to the feedback control for providing the above-mentioned target orbit, the moving velocity of the armature 57 can be restricted in real time control, thereby addressing a sudden misfire or the like.

Further, in the embodiment of the present invention, the target orbit for restricting the moving velocity of the armature 57 is set to correspond to the movement of the armature 57 under the biasing forces of the coil springs 56, 59 in the normal condition. Accordingly, no control for restricting the moving velocity is carried out in the normal condition, and therefore electric power consumption for the control can be saved in the normal condition while minimizing electric power consumption even when the moving velocity restricting control is carried out. Additionally, the armature 57 can sufficiently approach the electromagnet (for attracting the armature) under the biasing forces of the coil springs 56, 59; therefore, electric power consumption in the electromagnet for attracting the armature can be suppressed to a necessary minimum value.

It is to be noted that the target orbit in the above-mentioned "A" region may be set to restrict, largely, the moving velocity relative to the orbit in the normal condition, thereby obtaining a variety of control characteristics upon combining such a target orbit with the target orbit in the "B" region for the electromagnet for attracting the armature. For example, a more precise control for the velocity of the armature may be achieved by setting the target orbit in the "A" region at such a characteristic so as to restrict more largely the moving velocity and by advancing the initiation timing of current supply to the electromagnet for attracting the armature in the "B" region thereby enlarging a control range in the "B" region.

Figure 6:
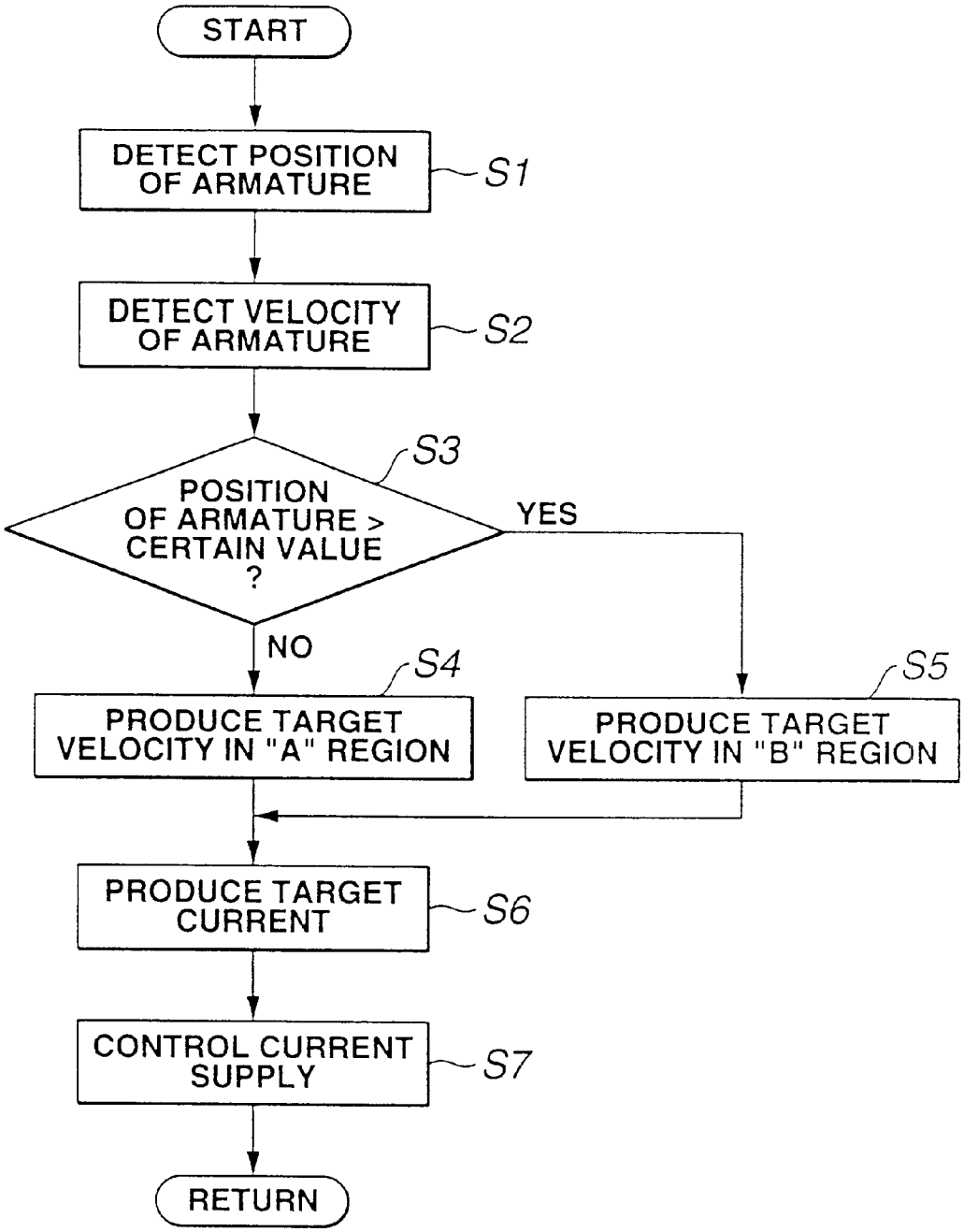
FIG. 6 is a flowchart of control for the electromagnetic actuator of FIG. 1.

The above control for the electromagnetically actuated valve will be discussed with reference to a flowchart of FIG. 6.

First, the position Z of armature 57 is detected at step S1. Then, a moving velocity dz/dt is detected in accordance with the position Z and a current i (to be fed to the electromagnet) corresponding to the position Z at step S2. Until the position Z reaches a certain value corresponding to the changing point between the "A" region and the "B" region, the target velocity corresponding to the target orbit in the "A" region is set at steps S3 and S4. When the position Z exceeds the certain value, the target velocity is produced corresponding to the target orbit in the "B" region, at steps S3 and S5. Then, the target current is calculated for the objective electromagnet in order to control the moving velocity of the armature at the target velocity, at step 6. Subsequently, a control for current supply to the objective electromagnet is made in accordance with the target current, at step S7.

While the moving velocity dz/dt of armature 57 has been shown and described as being detected in accordance with the position Z of the armature and the current i (corresponding to the position Z) to be supplied to the electromagnet so as to make a velocity sensor unnecessary, it will be understood that the velocity sensor may be used to detect the moving velocity of the armature.

The entire contents of Japanese Patent Application P11-345377 (filed Dec. 3, 1999) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A control system for an electromagnetic actuator comprising:

an electromagnetic actuator having an armature;

a plurality of springs biasing the armature toward a neutral position;

a first electromagnet to attract and displace the armature; and a second electromagnet to attract and displace the armature;

a controller adapted to control current supplied to the first electromagnet to restrict a moving velocity of the armature to a target moving velocity while the armature travels from a first electromagnet side to a second electromagnet side.

2. A control system as claimed in claim 1, wherein the target moving velocity is set corresponding to a position of the armature.

3. A control system as claimed in claim 1, wherein the amount of current supplied to the first electromagnet, when the armature travels from the first electromagnet side to the second electromagnet side, is based on a difference between the target moving velocity and an actual moving velocity.

4. A control system as claimed in claim 3, wherein the actual moving velocity is determined from an output of an armature position sensor.

5. A control system as claimed in claim 1, wherein the amount of current supplied to the first electromagnet, when the armature travels from the first electromagnet side to the second electromagnet side, is calculated by adding a feedback correction current to an actual current, and wherein the feedback correction current corresponds to a difference between the target moving velocity and an actual moving velocity.

6. A control system as claimed in claim 1, wherein the controller is adapted to control current supplied to the first electromagnet to restrict the moving velocity of the armature when the armature is in a first stage, and wherein the controller is adapted to initiate a supply current to the second electromagnet when the armature reaches a second stage following the first stage.

7. A control system as claimed in claim 6, wherein the controller is adapted to control current supplied to the second electromagnet so that the armature travels at a target moving velocity when the armature is in the second stage.

8. A method for controlling an electromagnetic actuator including first and second electromagnets each of which is adapted to generate an electromagnetic attraction force upon supply of current thereto, wherein the strength of the electromagnetic attraction forces generated by the first and second electromagnets changes in accordance with an amount of current being supplied thereto; an armature adapted to approach one of said first and second electromagnets in response to the electromagnetic force generated by that electromagnet; and a spring adapted to bias said armature to a neutral position between said first and second electromagnets, said method comprising:

decreasing the amount of current supplied to said first electromagnet, said decrease in the amount of current occurring when moving said armature from a first electromagnet side to a second electromagnet side; and initiating a supply of current to said first electromagnet when said armature moves towards said second electromagnet and when an actual moving velocity of the armature is greater than a target velocity so as to reduce the moving velocity of said armature when moving said armature from the first electromagnet side to the second electromagnet side.

9. A control system comprising:

an electromagnetic actuator comprising first and second electromagnets each of which is adapted to generate an electromagnetic attraction force upon supply of current thereto, wherein the strength of the electromagnetic attraction forces generated by the first and second electromagnets changes in accordance with an amount of current being supplied thereto;

an armature adapted to approach one of said first and second electromagnets in response to the electromagnetic force generated by that electromagnet;

a spring adapted to bias said armature to a neutral position between said first and second electromagnets; and first means for decreasing the amount of current supplied to said first electromagnet, said decrease in the amount of current occurring when moving said armature from a first electromagnet side to a second electromagnet side; and second means for initiating a supply of current to said first electromagnet when said armature moves towards said second electromagnet and when an actual moving velocity of the armature is greater than a target velocity so as to reduce the moving velocity of said armature when moving said armature from the first electromagnet side to the second electromagnet side.

10. A control system comprising:

an electromagnetic actuator comprising first and second electromagnets each of which is adapted to generate an electromagnetic attraction force upon supply of current thereto, wherein the strength of the electromagnetic attraction forces generated by the first and second electromagnets changes in accordance with an amount of current being supplied thereto;

an armature adapted to approach one of said first and second electromagnets in response to the electromagnetic force generated by that electromagnet;

a spring adapted to bias said armature to a neutral position between said first and second electromagnets; and a control circuit, wherein the control circuit is adapted to decrease the amount of current supplied to said first electromagnet, said decrease occurring when moving said armature from a first electromagnet side to a second electromagnet side, wherein the control circuit is adapted to initiate a supply of current to said first electromagnet when said armature moves towards said second electromagnet and when an actual moving velocity of the armature is greater than a target velocity so as to reduce the moving velocity of said armature when moving said armature from the first electromagnet side to the second electromagnet side.

11. A control system as claimed in claim 10, wherein said control circuit is adapted to control the amount of current supplied to said first electromagnet in accordance with a first orbit which is set having the target velocity which is a velocity of said armature corresponding to a position of said armature.

12. A control system as claimed in claim 11, wherein said control circuit is adapted to control the amount of current supplied to said second electromagnet in accordance with a second orbit which is set based on a relationship between the position of said armature and the target velocity.

13. A control system as claimed in claim 10, wherein said first and second electromagnets are coaxial with each other, and wherein said armature is coaxial with and between said first and second electromagnets.

14. A control system for an electromagnetically actuated valve comprising:

first and second electromagnets each of which is adapted to generate an electromagnetic attraction force upon supply of current thereto, wherein the strength of the electromagnetic attraction forces generated by the first and second electromagnets changes in accordance with an amount of current being supplied thereto;

an armature adapted to approach one of said first and second electromagnets in response to the electromagnetic force generated by that electromagnet;

a spring adapted to bias said armature to a neutral position between said first and second electromagnets; and a control circuit, wherein the control circuit is adapted to decrease the amount of current supplied to said first electromagnet, said decrease in the amount of current occurring when said armature from a first electromagnet side to a second electromagnet side, wherein the control circuit is adapted to initiate a supply of current to said first electromagnet when said armature moves towards said second electromagnet and when an actual moving velocity of the armature is greater than a target velocity so as to reduce the moving velocity of said armature when moving said armature from the first electromagnet side to the second electromagnet side.

15. A control system as claimed in claim 14, wherein said electromagnetically actuated valve is an engine valve of an internal combustion engine.

16. A control system as claimed in claim 15, wherein said engine valve is an intake valve through which intake air is supplied to an engine cylinder of the engine.

17. A control system as claimed in claim 15, wherein said engine valve is an exhaust valve through which exhaust gas from an engine cylinder is discharged.

18. A control system comprising:

an electromagnetic actuator comprising first and second electromagnets each of which is adapted to generate an electromagnetic attraction force upon supply of current thereto, wherein the strength of the electromagnetic attraction forces generated by the first and second electromagnets changes in accordance with an amount of current being supplied thereto;

an armature adapted to approach one of said first and second electromagnets in response to the electromagnetic force generated by that electromagnet;

a spring adapted to bias said armature to a neutral position between said first and second electromagnets; and a control circuit, wherein the control circuit is adapted to decrease the amount of current supplied to said first electromagnet, said decrease occurring when moving said armature from a first position to a second position, wherein at the first position said armature is closer to said first electromagnet than to said second electromagnet, wherein at the second position said armature is closer to said second electromagnet than to said first electromagnet, wherein the control circuit is adapted to initiate a supply of current to said second electromagnet when said armature moves towards said second electromagnet in response to the biasing force of said spring so as to attract said armature toward the second electromagnet when changing said armature from the first position to the second position, and wherein said control circuit is adapted to initiate current to said first electromagnet if a moving velocity by which the armature moves towards the second electromagnet is greater than a target velocity.

* * * * *